United States Patent [19]

Miller

[11] Patent Number: 4,612,842

[45] Date of Patent: Sep. 23, 1986

[54] APPARATUS FOR CUTTING FILAMENTARY MATERIAL

[75] Inventor: Donald F. Miller, Hendersonville, Tenn.

[73] Assignee: E. I. Du Pont de Nemours and Company, Wilmington, Del.

[21] Appl. No.: 765,521

[22] Filed: Aug. 14, 1985

[51] Int. Cl.[4] ..... D01G 1/04

[52] U.S. Cl. ..... 83/24; 83/37; 83/100; 83/161; 83/346; 83/444; 83/913

[58] Field of Search ..... 83/24, 37, 100, 161, 83/346, 444, 913; 28/228, 231; 242/28, 36; 19/0.23

[56] References Cited

U.S. PATENT DOCUMENTS 3,485,120 12/1969 Keith .
3,590,257 6/1971 Mukai et al. .
3,598,328 8/1971 Richards et al. .
3,763,373 10/1973 Baber .
3,821,499 6/1974 Marsello et al. .
4,300,422 11/1981 Potter .
4,538,490 9/1985 Becker ..... 83/346
4,569,264 2/1986 Van Doorn et al. ..... 83/346 X

FOREIGN PATENT DOCUMENTS 1064904 4/1967 United Kingdom .
1089870 11/1967 United Kingdom .

*Primary Examiner*—Frank T. Yost

[57] ABSTRACT

A modification to a reel type staple cutter that includes a housing surrounding the cutter reel. The housing has a cam slot sized to permit passage of a single tow but to prevent passage of a knot tieing together two ends of tow. As the cutter turns the knot slides along the outside of the slot reaching the top of the housing. The knot remains on top of the housing until the ends of the knot are cut. Means are provided to remove the knot.

5 Claims, 4 Drawing Figures

10
45a
45
34
42
A
B
C
12
36
40
50
44
46

APPARATUS FOR CUTTING FILAMENTARY MATERIAL

BACKGROUND OF THE INVENTION

The invention relates to apparatus for cutting elongated tow into shorter lengths and the means for uniformly removing the cut material. More particularly, the invention provides a means for removing splices formed by knotting the ends of two tows together.

Cutters as described by Potter in U.S. Pat. No. 4,300,422 are broadly used for cutting tow into staple length fibers. These cutters include a rotatable reel having outwardly facing cutter blades against which the tow is wound and a fixed pressure roller pressing upon the tow wound around the reel resulting in cutting of the innermost layers of tow by the cutter blades. As cutting progresses a wad of cut staple fibers is forced inwardly between adjacent pairs of blades.

As currently handled, tow ends are spliced together using an interlacing jet. Such splicing permits continuity of operation through the cutter and the cutter can handle the interlaced splice. However these splices are highly entangled and difficult to open. Such splices when processed along with the staple fibers into certain spunlaced fabrics create defects in the fabrics in the form of unopened clumps called neps which show up as white spots on the spunlaced fabrics.

SUMMARY OF THE INVENTION

In order to overcome the above noted problem, instead of an interlace splice a large knot in used to tie the ends of two tows together, and as the knot is fed to the cutter, an apparatus cuts out the knot without loss of continuity of operation. An assembly located above the cutter reel includes a cam slot formed in a housing surrounding the cutter reel. The slot is sized to permit passage of a single tow rope through the slot but to prevent passage of the knot tieing the two (first and second) ends of tow together. As the cutter reel turns, the knot slides along the outside of the cam housing guided by the slot cam, reaching a position on top of the housing where it is excluded from the cutter reel. When the tails of the knot reach the cutter blades, they are cut and the knot with associated tails is removed by means of a mechanical ejector or alternatively by vacuum. Inasmuch as the second end of tow is already wrapped on the cutter reel, there is no loss of continuity. The method is repeated for continued operation.

The apparatus includes a cutting assembly with a plurality of knife edges secured to a reel, rotatable in a frame, having an upper and a lower mounting member and with means adapted to receive successive wrappings of filamentary material traveling in a path toward said assembly to be cut. The improvement comprises: a housing surrounding the cutting assembly, the housing is formed of a continuous upstanding side wall and a top attached to the wall. There is a cam slot located in the side wall and the top. The slot begins on the sidewall at a point prior to the path which the tow travels and ends at the top of the housing above said reel. A means is provided for removing the knot after the ends are cut.

DETAILED DESCRIPTION OF THE PREFERRED EMBODIMENTS

Figure 1:
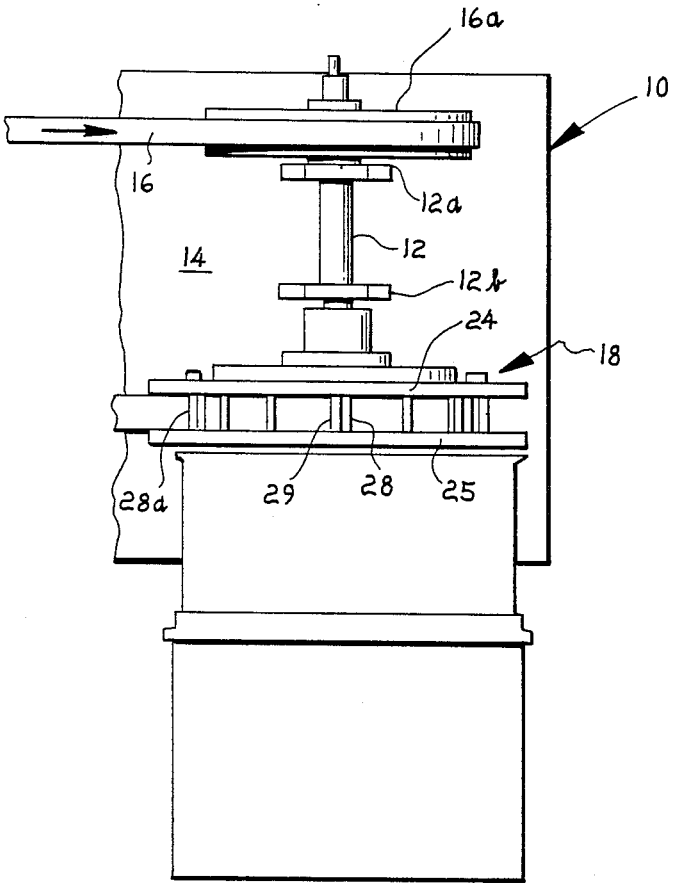
Fig. 1 (PRIOR ART)
FIG. 1 is a side elevation view of the cutting apparatus similar to the Potter apparatus illustrating the relationship between the various elements thereof and showing a preferred cutting reel configuration.

Referring to FIG. 1, the embodiment chosen for purposes of illustration is a prior art type cutting apparatus 10 that includes as its major components a drive shaft 12 mounted on a base 14 by means of bearings **12*a* and 12*b* and connected to a cutting reel designated generally 18. The shaft 12 is driven by a motor (not shown) via belt 16 engaging pulley 16*a* attached to shaft 12. The cutting reel 18 is seen to comprise a bottom ring 25 attached to and spaced from a top plate 24 by spaced connector posts 29 which are secured in position by any of a number of well known expedients as, for example, brazing. Rectangular cutter blades 28 are inserted through slots in top plate 24 down into grooves in the top of ring 25. When in place, each cutter blade 28 has its cutting edge 28*a* facing radially outwardly, and its back edge supported in U-groove of a connector post 29 and its top end extending into an annular space above plate 24**.

The cutter is substantially the same as that disclosed by Potter in U.S. Pat. No. 4,300,422 the operation of which is described in detail at column 4 of the Potter patent.

Figure 2:
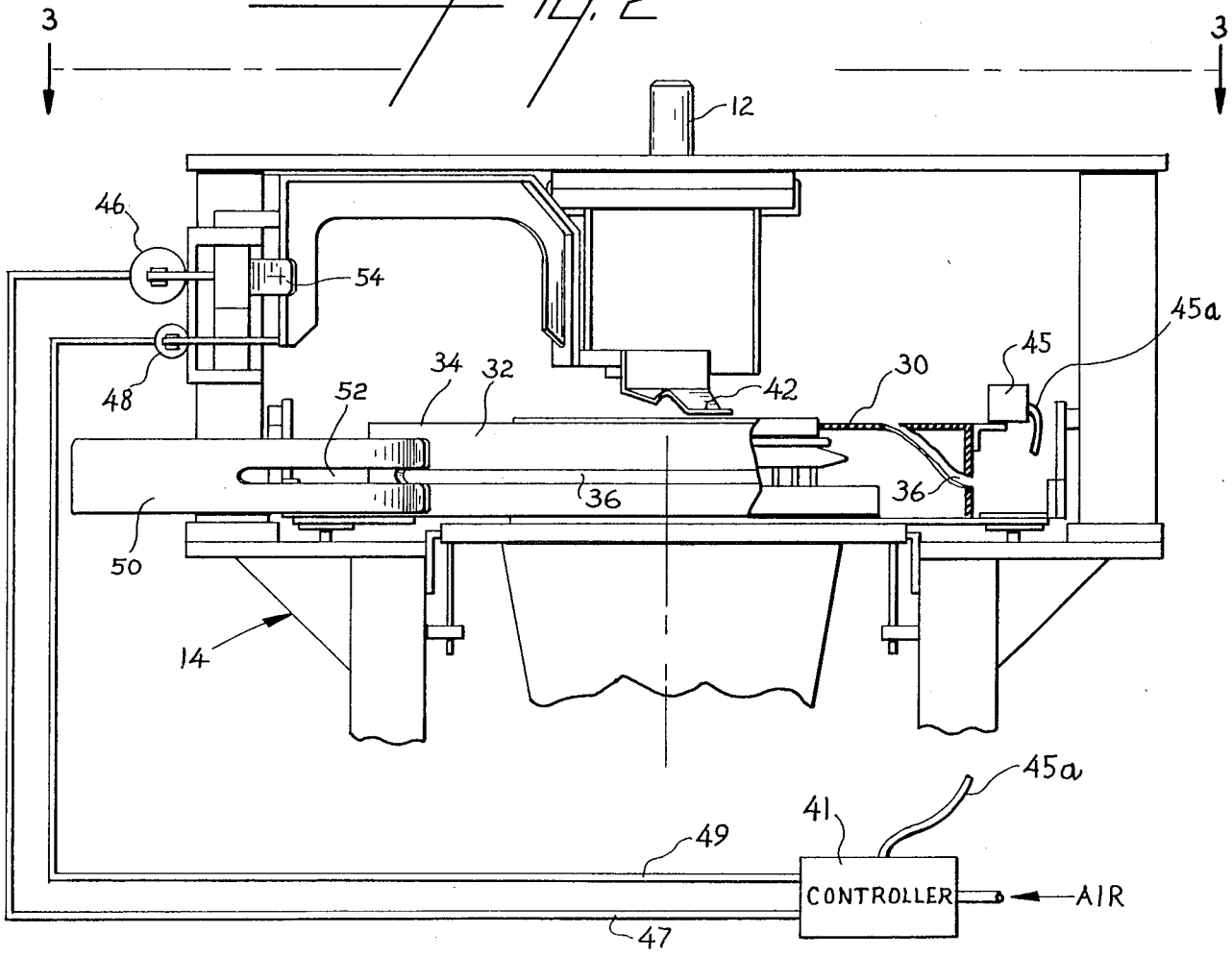
FIG. 2 is an enlarged detailed partially sectioned elevation view of the cutting reel, with the cam housing and associated parts for using in cutting out knots.
Figure 3:
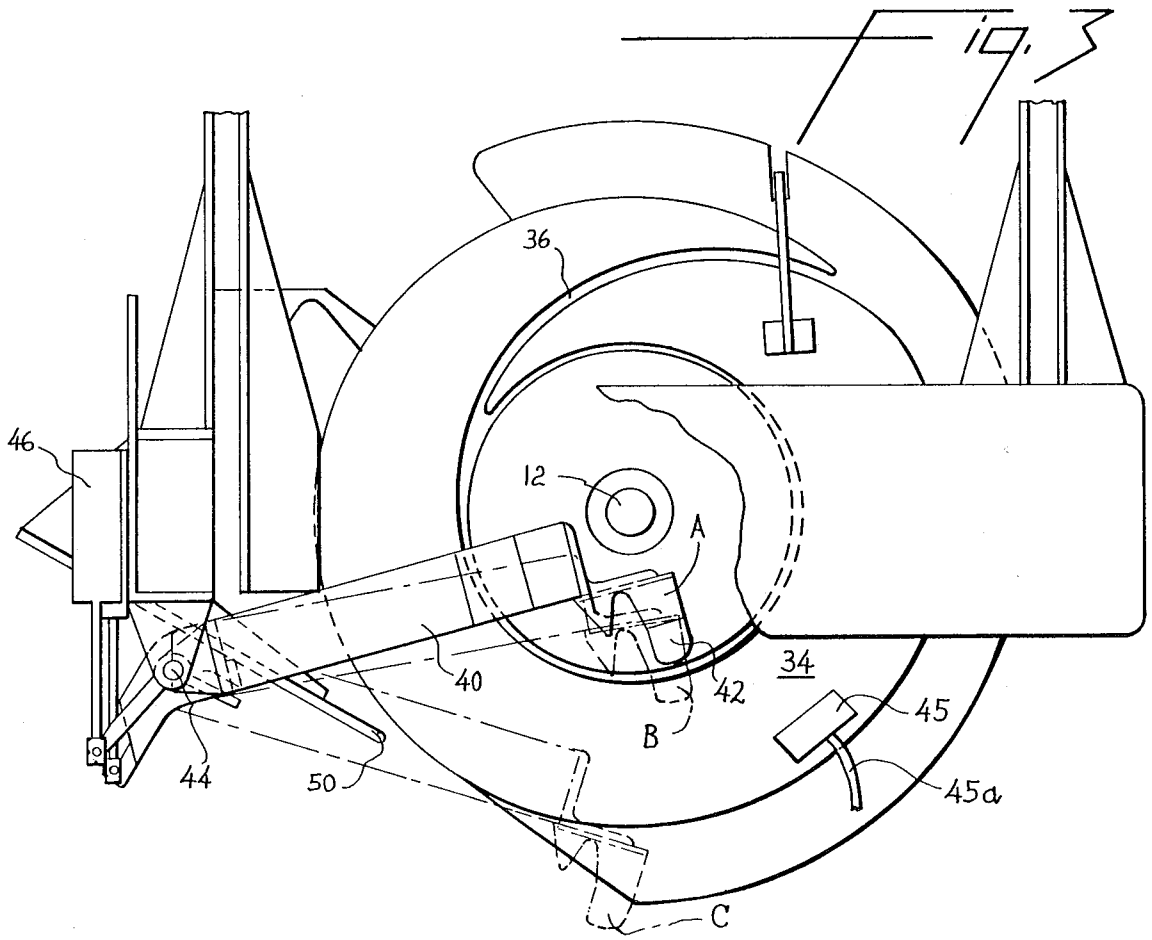
FIG. 3 is a view taken along 3—3 of FIG. 2.

The improvement of this invention is a modification of the known cutter reels shown in FIGS. 2 and 3 that provides a housing 30 attached to the base 14. The housing is formed of an upstanding side wall 32 and a top 34 attached to the sidewall. There is a cam slot 36 formed in the side wall 32. The slot 36 continues into the top of the housing (FIG. 3) and is sized to permit passage of a single tow rope through the slot, but to prevent passage of a knot resulting from the tieing together of two ends of tow rope. A mechanical arm 40 having a slotted foot 42 on one end and being pivotally attached to frame 14 at pivot 44 is located for pivotal sweeping movement of slotted foot 42 across a section of cam slot to engage a knot at that loctaion. Cylinders 46, 48 linked to arm 40 provide the means to move the arm back and forth across slot 36. A deflector 50 attached at one end to frame 14 has a slot 52 at its other end sized to allow tow to pass through to the cutter but deflect knots to the wall 32 of housing 30 where they ride the surface of the wall and top guided by cam slot 36 to the top of the housing. The tails are then cut and the knots and associated tails are removed by the movement of foot 42 attached to arm 40.

Figure 4:
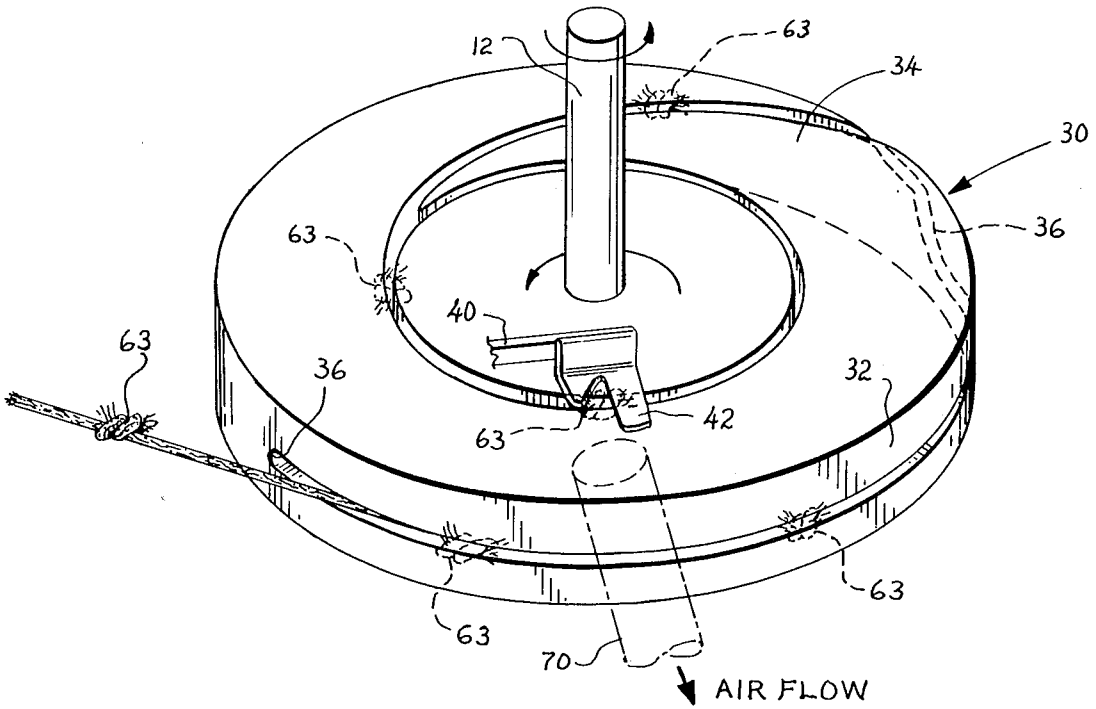
FIG. 4 is a schematic view of the apparatus of this invention showing a progression sequence of the travel of two ends of tow tied into a knot as it goes into the cutter.

Referring now to FIG. 4 the operation of the apparatus can be seen sequentially as follows: two ends of two 60, 62 are tied together in a knot 63, the tow enters cam slot 36 in side wall 32 of housing 30. The slot 36 is sized to exclude knot 63 so that as the cutter reel 18 rotates winding and cutting the tow, knot 63 slides along the outside of wall 32 following cam slot 36 to the top 34 of the housing 30. The knot 63 remains on the top 34 of the housing until the ends of tows 60, 62 reach the staple cutter reel blades and are cut. The knot 63 is then engaged by the foot 42 of ejector arm 40 and removed.

The operation of the ejector arm 40 is controlled by a commercial programmable controller 41 (model No. Mini PLC-2 by Allen Bradley) which gets a signal through cable 45*a* from electric eye knot detector 45 mounted in the tow path ahead of the cutter. The knot 63 rotates around the top of housing 30 for 3 to 10 revolutions which are counted by electric eye 45 mounted on 30 (FIG. 3). During this part of the cycle both air cylinders 46 and 48 shown on FIG. 2 are pressurized, through pipelines 47, 49 respectively, on the head end of their pistons to keep their rods fully extended holding ejector arm 40 in position A. After the knot 63 has made 3 to 10 revolutions the programmable controller switches the air pressure in cylinder 48 from head end to rod end and this causes ejector arm 40 to move ejector foot 42 to position B. At position B the knot is stopped by 42 while the cutter reel continues to rotate, thus, pulling the tail ends of the knot splice from the tow being cut on the cutter reel. The ejector foot remains at position B for 5 seconds. The stroke of cylinder 48 is limited at this time by cylinder 46 which is larger in diameter and thus can stop further motion of cylinder 48. The stop 54 is best shown on FIG. 2.

After the 5 seconds has expired the programmable controller 41 reverses the air from head end to rod end on cylinder 46. This retraction of the cylinder rod of cylinder 46 moves the stop 54 out of the way of lever 40 and lever 40 moves to position C driven by cylinder 48. The ejector foot 42 drags the knot splice from the cam track while moving from position B to C where the knot splice falls under the force of gravity to a waste box positioned under position C. This action completes the knot extraction and 5 seconds later the pressure on both air cylinders is reversed and ejector arm 40 returns to its home position A and waits for the next knot splice to be positioned.

As an alternate for removal of the knot a vacuum nozzle 70 (FIG. 4) could be placed at a location now occupied by foot 42 and used to draw the knot 63 away from the top of housing 30.

I claim:

1. In an apparatus for cutting tow into predetermined lengths including a frame, a driven cutting reel rotatable in said frame for receiving successive wrappings of tow moving in a path toward the reel to be cut, an apparatus for removing knots formed by tieing the ends of two single tows together said apparatus comprising: a housing attached to said frame, said housing surrounding said reel, and having a continuous upstanding side wall and a top attached to the wall, said side wall and said top having a cam slot formed therein, said slot being sized to permit passage of a single tow, but to prevent passage of a knot, said cam slot having one end in alignment with said path and the other end of the slot terminating on the top of the housing; and means for removing the knot when the ends are cut by the reel.

2. The apparatus of claim 1, wherein said means for removing the knot when its ends are cut comprises: an arm pivotally mounted to said frame for back and forth movement across said slot in said top; a slotted foot attached to one end of said arm for engaging said knot; means for moving said arm; and a linkage coupling the other end of said arm and said means for moving the arm.

3. The aparatus for claim 1, wherein said means for removing said knot is a source of vacuum adjacent the location of the knot.

4. The apparatus of claim 1 including a deflector to deflect said knot from said path to the side wall of the housing and to guide the tow into said cam slot in the side wall of the housing.

5. A method for continuously cutting tow into predetermined lengths comprising the steps of: (a) feeding one end of a first tow into the cutter reel of a staple cutter for cutting the tow into predetermined lengths; (b) supplying one end of a second tow adjacent to the other end of said first tow; (c) tying said one end of said second tow and said other end of said first tow into a knot; (d) excluding said knot from said cutter reel while allowing said one end of said second tow to become wrapped on said cutter reel; (e) cutting said other end of said first tow and said one end of said second tow by means of said cutter reel; (f) removing said knot; and (g) repeating steps (a) through (f).

* * * * *